US010406709B2

(12) United States Patent
Pappas et al.

(10) Patent No.: US 10,406,709 B2
(45) Date of Patent: Sep. 10, 2019

(54) SCORE KNIFE POSITIONER

(71) Applicant: Catbridge Machinery LLC, Montville, NJ (US)

(72) Inventors: Michael T. Pappas, Boonton, NJ (US); Michael F. Yermal, Dover, NJ (US)

(73) Assignee: CATBRIDGE MACHINERY, LLC, Montville, NJ (US)

( * ) Notice: Subject to any disclaimer, the term of this patent is extended or adjusted under 35 U.S.C. 154(b) by 74 days.

(21) Appl. No.: 14/725,358

(22) Filed: May 29, 2015

(65) Prior Publication Data

US 2015/0343660 A1 Dec. 3, 2015

Related U.S. Application Data

(60) Provisional application No. 62/005,445, filed on May 30, 2014.

(51) Int. Cl.

| | |
|---|---|
| ***B26D 7/26*** | (2006.01) |
| ***B26D 5/06*** | (2006.01) |
| ***B26D 1/18*** | (2006.01) |

(52) U.S. Cl.

CPC ..... *B26D 5/06* (2013.01); *B26D 1/185* (2013.01); *B26D 7/2635* (2013.01); *B26D 2007/2657* (2013.01); *Y10T 83/263* (2015.04); *Y10T 83/7747* (2015.04); *Y10T 83/7851* (2015.04); *Y10T 83/7872* (2015.04); *Y10T 83/7876* (2015.04)

(58) Field of Classification Search

CPC ..... B26D 7/2635; B26D 2007/2657; B26D 1/185; B26D 1/0006; B26D 9/00; B26D 2001/0046; B26D 2007/2685; B26D 1/18; B26D 7/2621; Y10T 83/7876; Y10T 83/7747; Y10T 83/7851; Y10T 83/263; Y10T 83/7877; Y10T 83/303; Y10T 83/7868; D06H 7/04

USPC ..... 83/13, 174, 425.4, 436.15

See application file for complete search history.

(56) References Cited

U.S. PATENT DOCUMENTS

| | | | | |
|---|---|---|---|---|
| 1,360,076 A | | 11/1920 | Bassaler | |
| 3,055,247 A | * | 9/1962 | Goble | B26D 5/04 83/425 |
| 3,834,258 A | | 9/1974 | Zumstein | |
| 4,188,846 A | * | 2/1980 | Jones | B26D 7/2635 83/499 |
| 4,204,445 A | * | 5/1980 | Goldinger | C03B 33/10 83/880 |
| 4,316,317 A | * | 2/1982 | Ritzling | B26D 7/2628 29/468 |

(Continued)

*Primary Examiner* — Ghassem Alie

(74) *Attorney, Agent, or Firm* — Chiesa Shahinian & Giantomasi PC

(57) ABSTRACT

A score knife positioner includes a carriage bracket having a locating tab for receiving a score knife assembly. Linear bearings are attached to the carriage bracket and are configured to engage with a pair of guide rails. The linear bearings are offset from one another and located so that score knife positioners on either side of a particular score knife positioner can be nested together. The carriage bracket has a width less than a width of the score knife assembly and allows adjacent score knife assemblies to be positioned so that there is less than one-half inch between score knifes. Score knife positioners can be moved to a desired location and locked into place via a carriage brake attached to the carriage bracket.

19 Claims, 16 Drawing Sheets

(56) References Cited

U.S. PATENT DOCUMENTS

| | | | | |
|---|---|---|---|---|
| 4,540,394 | A | 9/1985 | Cavagna | |
| 4,604,934 | A * | 8/1986 | Elliott | C03B 33/027 83/425.4 |
| 5,259,255 | A | 11/1993 | Urban | |
| 5,966,970 | A | 10/1999 | Mooney | |
| 6,012,372 | A * | 1/2000 | Laster | B27B 5/325 83/504 |
| 6,227,092 | B1 | 5/2001 | Ivel | |
| 6,732,625 | B1 | 5/2004 | Boynton | |
| 8,312,798 | B2 * | 11/2012 | Kwarta | B26D 1/185 83/425.3 |
| 2003/0192413 | A1 * | 10/2003 | Aoki | B26D 7/2635 83/13 |
| 2006/0162519 | A1 | 7/2006 | Pappas | |
| 2009/0071305 | A1 | 3/2009 | Myers | |
| 2010/0218658 | A1 * | 9/2010 | Myers | B26D 1/0006 83/174 |

* cited by examiner

SCORE KNIFE POSITIONER

This application claims the benefit of U.S. Provisional Application No. 62/005,445 filed May 30, 2014, which is incorporated herein by reference.

BACKGROUND

The present disclosure relates generally to web converting, and more particularly to score slitting and automatic score knife positioning.

Large amounts of material rolled onto cylindrical cores often require slitting to produce the desired finished roll widths. For example, a large roll of adhesive tape material having a width measured in feet may require slitting to narrower widths for use by consumers. As such, large rolls of material must be unwound, slit and rewound into a variety of smaller desired widths and diameters. Slitting the large rolls of material requires positioning of devices such as score knives. This positioning and subsequent repositioning requires time which increases the amount of time needed to convert a large roll of material into smaller widths.

SUMMARY

In one embodiment, a method for positioning a score knife carriage assembly includes engaging a portion of a score knife holder of a first score knife carriage assembly with a fork member of a pick and place mechanism. The first score knife carriage assembly is slidably engaged to a first guide rail via a linear bearing. In one embodiment, the first score knife carriage assembly is engaged when the assembly is located in a storage area located at an end of the first guide rail. The forked member of the pick and place mechanism slidably moves the first score knife carriage assembly to a first predetermined location using the forked member of the pick and place mechanism. The first score knife carriage assembly is then locked to a brake plate at a first predetermined location. The forked member of the pick and place mechanism is then disengaged from the score knife holder of the first score knife carriage assembly. In one embodiment, a portion of a score knife holder of a second score knife carriage assembly is engaged by the forked member of the pick and place mechanism and slidably moved to a second predetermined location so that a score knife of the second score knife carriage assembly is located approximately one-half inch from a score knife of the first score knife carriage assembly. The second score knife carriage assembly is then located to a brake plate at the second predetermined location and the forked member is disengaged. In one embodiment, the first score knife carriage assembly is locked using a pneumatically actuated brake. In one embodiment, the forked member of the pick and place mechanism engages the second score knife carriage assembly and moves the assembly to a third predetermined location after the assembly is unlocked. In one embodiment, the second score knife carriage assembly is moved to a storage area located at an end of the second guide rail.

These and other advantages of the invention will be apparent to those of ordinary skill in the art by reference to the following detailed description and the accompanying drawings.

DETAILED DESCRIPTION

Figure 1:
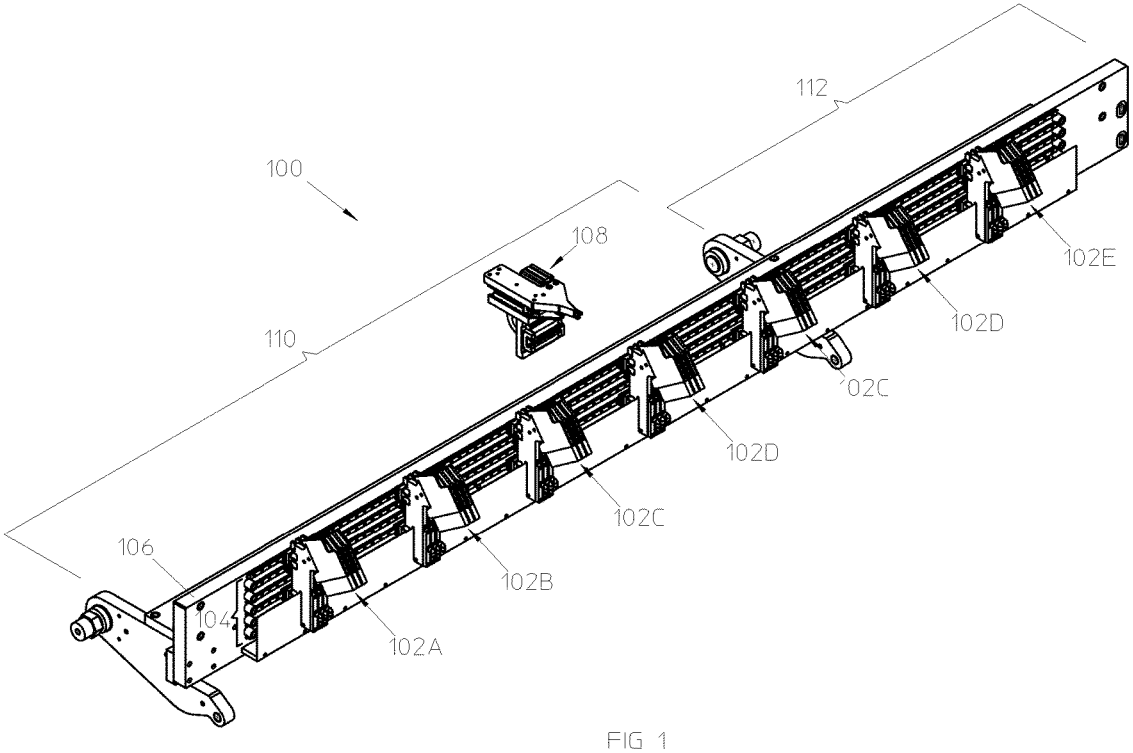
FIG. 1 depicts a score knife positioning assembly of a web converting machine according to one embodiment.

Existing score knife positioning systems each have their drawbacks. Some systems do not have the capability to slit rolls this narrow. Those that can slit down to ½" wide rely on multiple banks of knives to achieve the required density. This leads to complex mountings and poor access to areas that require frequent maintenance. Existing systems utilize a single brake mechanism that engages simultaneously once all the knives are positioned. This design permits individual knives that have been positioned to drift out of location while the system is in the process of positioning the remaining knives. This drift is often caused by the pull from the necessary hoses and/or wires that are tethered to each slitting unit. Another disadvantage of existing braking systems is that they are prone to contamination problems due to oils that are commonly used in the immediate vicinity. These oils tend to attack the pneumatically actuated bladders used in the braking system. The rubber bladders can also develop a 'memory' at locations that are used frequently because steps form in the rubber surface. Knives tend to move laterally into these stepped areas after they have been positioned when the bladder expands to clamp the knife assembly.

In general, score knife positioning systems utilize score knife holders fitted to movable carriages that are positioned by a servo-controlled actuator. The knife holders are available as standard items from many commercial sources. Existing knife positioning systems position the knives by moving the carriage on which the knife holder mounts. It is, therefore, critical that the knife holder location on the carriage is calibrated in order to ensure accuracy of knife placement. The need to calibrate each knife holder on each carriage involves additional labor and skill by the operator or mechanic. When a knife holder is removed from the carriage for servicing, it needs to be re-calibrated when it is re-installed. Thus, there is a need to provide an accurate means of mounting the knife holders to the carriages without the need for these manual calibrations.

All knife positioning systems utilize a means to move individual knives to the desired locations to obtain the required slit widths. Existing systems accomplish this by engaging a coupling device with the movable carriage so that the carriage can be moved laterally as needed. The location where this connection occurs is remote from the actual component that needs to be accurately positioned, namely the score holder itself. Several sources for error and inaccuracy result from this indirect positioning of the blade. Dimensional tolerance buildup, guide rail clearance, deflection and out-of-square mounting between the knife holder and the movable carriage all contribute to system inaccuracy. Given these errors, it is possible to have a movable carriage located in the correct theoretical position yet have the actual slit width be out of tolerance.

Another feature commonly used with score slitting is a wicking attachment fitted to each score knife holder. Many products that are score slit have exposed adhesive. The adhesive tends to build up on the score knife blade as it cuts. To prevent this build up, a wicking attachment is used to apply an oil film to the blade as it rotates. The film of oil prevents the adhesive from sticking to the blade. The wick is normally made of felt and acts as a reservoir for the oil. The oil has to be replenished frequently to prevent adhesive buildup. For safety reasons, it may be necessary to stop the machine winding in order to re-oil the wicks. This reduces machine productivity. Some slitting systems use a common wick that spans all of the knives. This causes inconsistent oil supply because all blades get oiled, even the ones not in use. Both systems tend to contaminate the entire slitting area with oil.

Material scoring, cutting, and slitting machines process a variety of material generally formed as large webs. These webs are typically rolled onto cylindrical cores to form master rolls to facilitate shipping and handling of the material prior to processing of the material. These master rolls of material can be several feet in width and diameter and must be processed to convert a large roll of material into smaller sizes and amounts depending on an intended use of the material. For example, master rolls of material used for masking tape must be cut to standard widths and lengths for use by consumers. These standard widths typically range from one-half of an inch to two inches with a variety of widths in between such as three-quarters of an inch and one inch widths. Wider roll widths are also common for specialized products. When processing a master roll of material, several score knives are used to cut the large roll of material to the desired widths. These score knives are positioned apart from one another to produce the desired widths by conveying material between a blade of each score knife and a large score roller having a width the same width or slightly larger width than the material being processed. These score knives must be repositioned in order for different finished roll widths to be produced. For example, a master roll of material may be cut into numerous three-quarter inch widths. After a desired amount of three-quarter inch width material is produced, the knives may be repositioned to produce one-half inch width material. Score knives, in one embodiment, are contained in holders which allow a score knife to be replaced by removing the score knife and holder from a carriage assembly for maintenance. According to one embodiment, a carriage assembly is configured to produce material widths limited only by the width of the score knife holders.

FIG. 1 depicts score knife positioning assembly 100 of a web converting machine according to one embodiment. A common application of the web converting machine of FIG. 1 requires the capability of slitting a large diameter master roll into many smaller diameter rolls as narrow as ½" wide. Often, production runs for a given slitting pattern can be quite short and the need to change slit widths can occur several times in a single work shift. Also, manual positioning of score knives can lead to unacceptable accuracies for the finished roll widths. Score knife positioning assembly 100 comprises a plurality of sets of score knife carriage assemblies 102A-102E wherein each set comprises three score knife carriages. Each of the score knife carriages of the plurality of sets of score knife carriage assemblies 102A-102E are slidably connected to a pair of guide rails of a plurality of guide rails 104. Each of the plurality of guide rails 104 is attached to positioning back plate 106 which can be moved toward and away from a score roller (not shown). The score roller is located substantially parallel to operating section 110 of score knife positioning assembly 100 and provides a surface to oppose score knife edges of score knives of score knife carriage assemblies 102A-102E. One or more score knife carriages of the plurality of sets of score knife carriages are moved to a desired location within operating section 110 of score knife positioning assembly 100 so that the associated score knives can be used in conjunction with the score roller to cut web material moving between the score knives and the score roller. Each score knife carriage assembly of the plurality of sets of score knife carriage assemblies 102A-102E can be moved to a desired location by pick and place mechanism 108. Score knife carriage assemblies to be used in the conversion of web material are moved to operating section 110 of score knife positioning assembly 100 which is opposite a score roller (not shown). Score knife assemblies that are not needed for a current web conversion operation are moved to storage area 112 of score knife positioning assembly 100.

Figure 2:
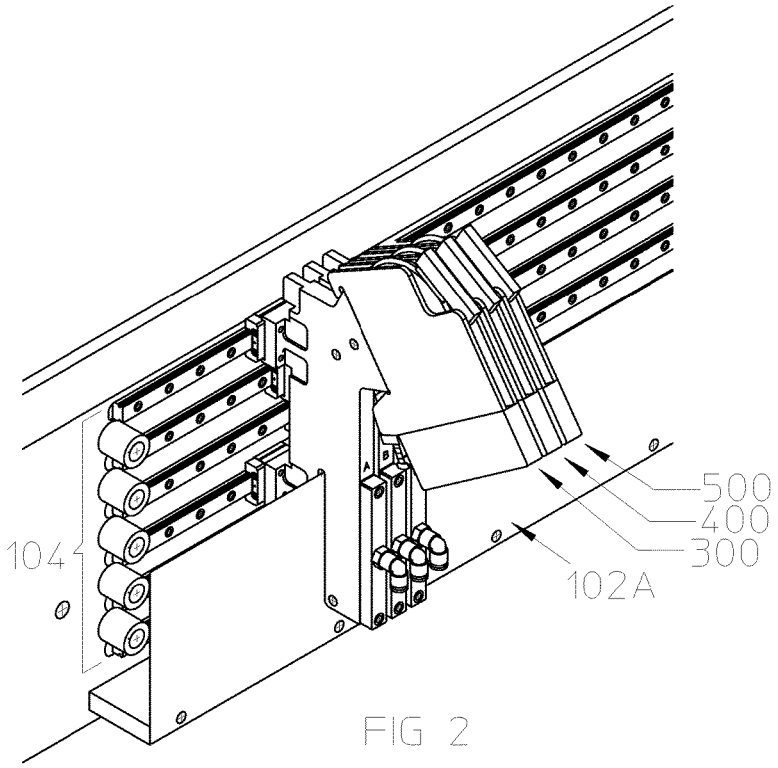
FIG. 2 depicts a set of score knife carriage assemblies according to one embodiment.

FIG. 2 depicts a detail of a set of score knife carriage assemblies 102A comprising score knife carriage assemblies 300, 400, and 500. Each score knife carriage assembly 300, 400, and 500 is constructed to nest with adjacent score knife carriage assemblies so that score knives of adjacent score knife carriages are less than one-half of an inch from one another.

Figure 3A:
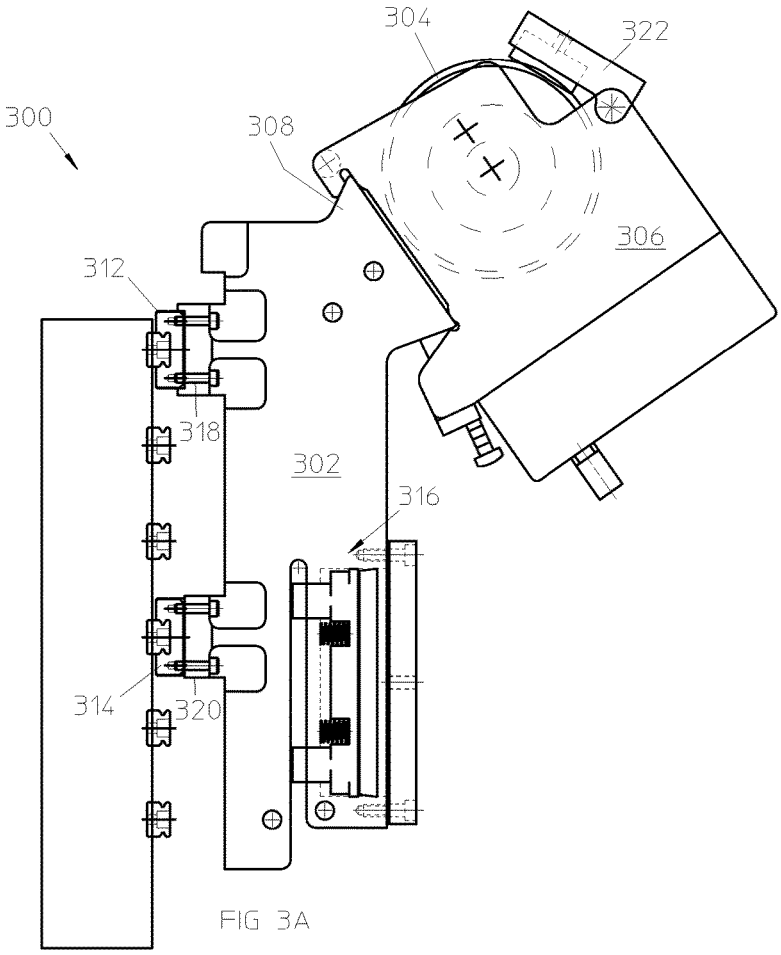
FIG. 3A depicts a side view of a score knife carriage assembly according to one embodiment.
Figure 3B:
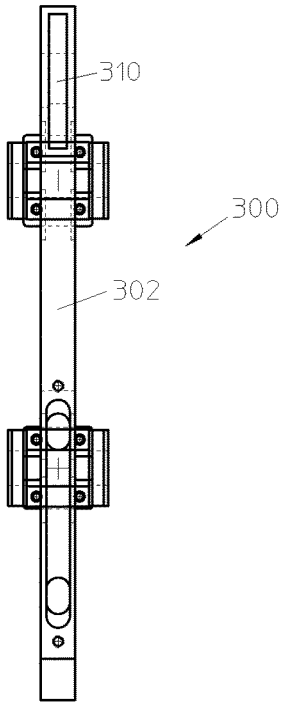
FIG. 3B depicts a top view of the score knife carriage assembly of FIG. 3A.

FIG. 3A depicts a side view of score knife carriage assembly 300 of FIG. 2 and FIG. 3B depicts a top view of score knife carriage assembly 300. Score knife carriage assembly 300 comprises carriage bracket 302 configured to support score knife holder 306, linear bearings 312, 314 and carriage brake assembly 316.

Score knife holder 306 is located on one side of carriage bracket 302 and comprises, in one embodiment, score knife blade 304 having a circular shape. Score blade 304 is supported in score knife housing 306 in a manner to allow score blade 304 to rotate about its central axis. Dovetail 308 and a locating rib 310 (shown in FIG. 3B) on carriage bracket 302 are configured to engage and locate score knife holder 306 on carriage bracket 302. Locating rib 310 and dovetail 308 facilitate replacement of score knife holder 306 without the need to re-calibrate the relative position of the score knife holder on carriage assembly. Score knife holder 306, in one embodiment, is locked onto dovetail 308 using various methods, for example, a screw clamp or toggle clamp. Score knife blade 304 is actuated into the cutting position against the score roller by compressed air acting on a piston in the score knife holder (not shown).

Carriage bracket 302 is configured to retain and locate a pair of linear bearings 312, 314. Linear bearings 312, 314 in one embodiment, are spaced apart from one another as shown in FIGS. 3A and 3B and are configured to engage a pair of guide rails (not shown). Linear bearings 16, 18 slidably engage the pair of guide rails and allow carriage assembly 10 to be moved parallel to a score roller (not shown). The linear bearings and rails provide a precise, low friction, high load capacity mounting means for the carriage assemblies. However, to achieve these characteristics, the bearings themselves are substantially wider than the desired ½" minimum slit width. Thus it becomes necessary to mount the bearings in such a way so as to obtain an effective slit width less than or equal to ½". To accomplish this, the linear bearings attach to feet 318, 320 of carriage bracket 302. Feet 318, 320 are a width suitable for mounting the linear bearings and are staggered in such a way so as to allow a second adjacent carriage bracket with an alternate staggered foot arrangement to nest closely together to permit the score knife holders to achieve a ½" minimum pitch distance between them. A third adjacent carriage bracket with an alternate staggered foot arrangement permits its' score knife holder to similarly nest to achieve a ½" minimum pitch distance between it and the second score knife holder on one side and a first score knife holder on the opposite side. The staggered nesting pattern of the first, second and third carriage bracket feet repeats on successive carriage brackets to maintain the nesting characteristic across all of the carriage assemblies in the system.

Carriage brake assembly 316 is located on an end of carriage bracket 302 and is configured to lock carriage assembly 300 in a desired position with respect to a score roller (not shown).

In one embodiment, wick assembly 322 is attached to score knife holder 306 and provides lubricant to score blade 304 of score knife holder 306 to prevent adhesive from the web from sticking to the blade. In one embodiment, wick assembly 322 is configured to provide lubricant to score blade 304 only when that knife is activated. This is accomplished by providing a control valve for each wick that either permits or blocks lubricant from flowing from a centralized reservoir to the wick. The lubricant control valve is actuated to permit lubricant flow whenever the associated score knife holder is energized. The lubricant flow control valve can be pulsed as needed to provide flow at timed intervals to optimize delivery of lubricant. This eliminates the need to periodically stop a machine utilizing score knife carriage assembly 300 to manually re-lubricate individual wicks. This also prevents over-lubrication of inactive knives such as when a common wicking element is used to lubricate all knives simultaneously whether they are activated or not.

Figure 4A:
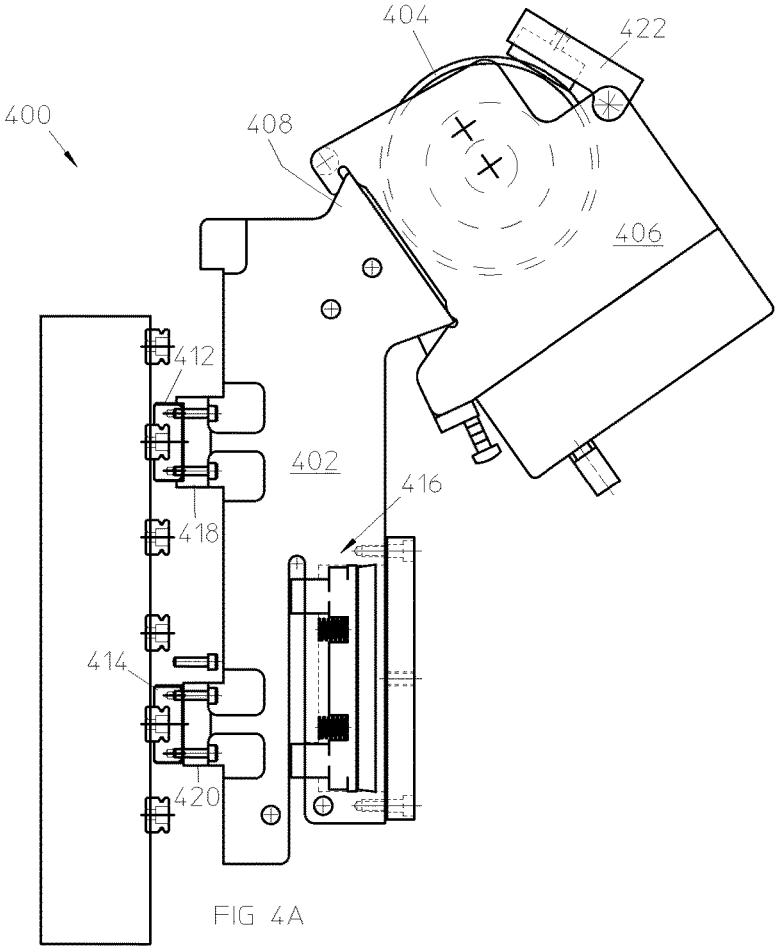
FIG. 4A depicts a side view of a score knife carriage assembly according to one embodiment.
Figure 4B:
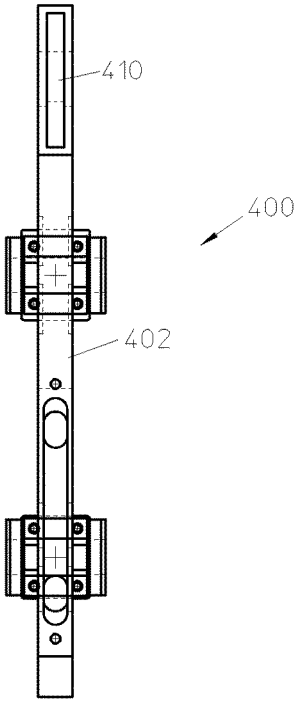
FIG. 4B depicts a top view of the score knife carriage assembly of FIG. 4A.

FIG. 4A depicts a side view of score knife carriage assembly 400 of FIG. 2 and FIG. 4B depicts a top view of score knife carriage assembly 400. Score knife carriage assembly 400, in one embodiment, is substantially identical to score knife carriage assembly 300 of FIGS. 3A and 3B with the exception of the location of linear bearings 412, 414, and carriage bracket feet 418,420. As described above, carriage bracket feet 418,420 of score knife carriage assembly 400 are offset so that score knife carriage assembly 400 can nest with adjacent score knife carriage assemblies.

Figure 5A:
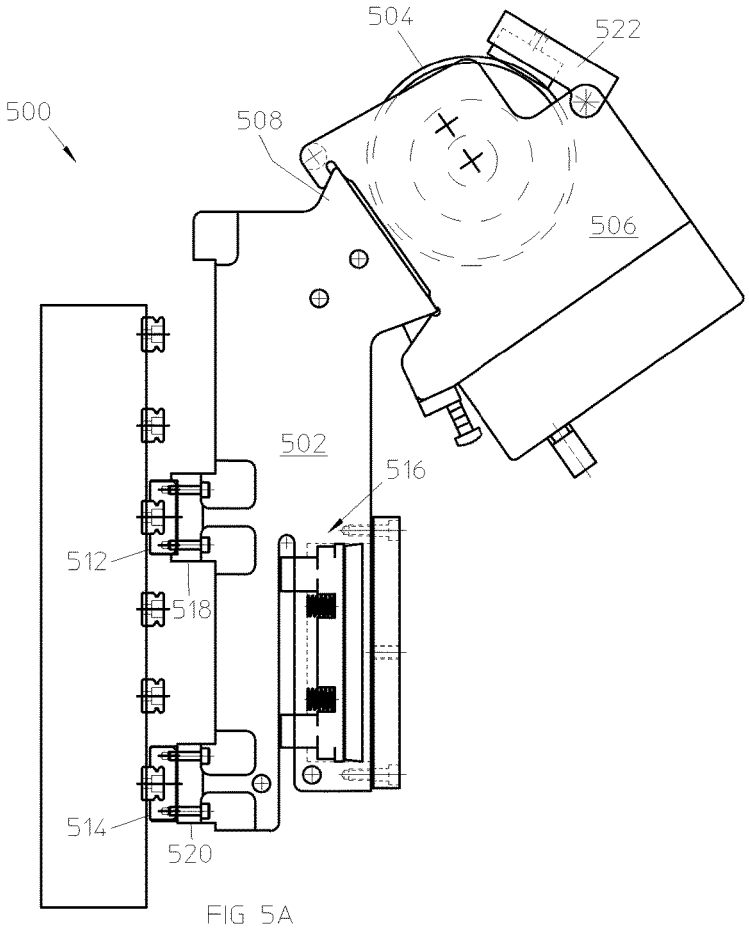
FIG. 5A depicts a side view of a score knife carriage assembly according to one embodiment.
Figure 5B:
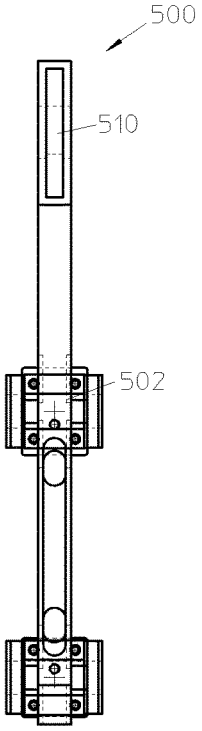
FIG. 5B depicts a top view of the score knife carriage assembly of FIG. 5A.

FIG. 5A depicts a side view of score knife carriage assembly 500 of FIG. 2 and FIG. 5B depicts a top view of score knife carriage assembly 500. Score knife carriage assembly 500, in one embodiment, is substantially identical to score knife carriage assembly 300 of FIGS. 3A and 3B with the exception of the location of linear bearings 512, 514, and carriage bracket feet 518,520. As described above, carriage bracket feet 518,520 of score knife carriage assembly 500 are offset so that score knife carriage assembly 500 can nest with adjacent score knife carriage assemblies.

Figure 6:
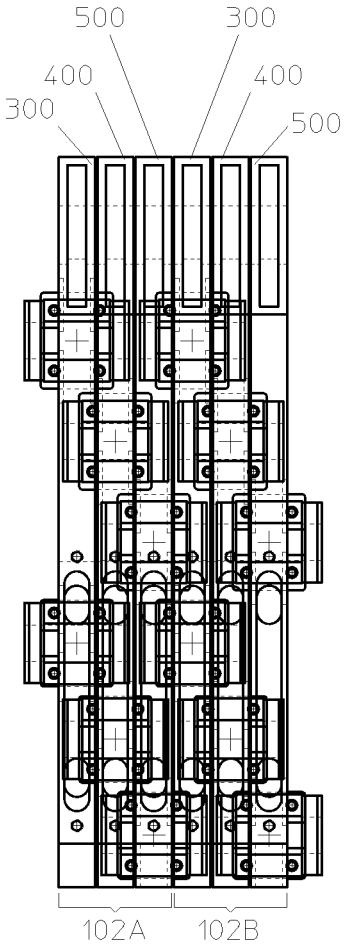
FIG. 6 depicts two sets of score knife carriage assemblies according to one embodiment.

FIG. 6 depicts a set of score knife carriage assemblies 102A with each score knife carriage assembly 300, 400, and 500 nested together. As shown in FIG. 6, the offset of linear bearings of each score knife carriage assembly allow adjacent score knife carriage assemblies to nest to one another so that score knife holders of adjacent score knife carriage assemblies are contacting one another. Set of score knife carriage assemblies 102B is similarly nested together and score knife carriage assembly 300 of set of score knife carriage assemblies 102B is shown nesting with score knife carriage assembly 500 of set of score knife carriage assemblies 102A. As such, FIG. 6 depicts how adjacent score knife carriage assemblies can be nested together to produce an endless number of slit widths of less than ½ inch.

Nesting refers to how two or more score knife positioners are configured to mesh with one another in order to provide the smallest possible distance between two adjacent score knives. In one embodiment, components of a set of three score knife positioners are configured to allow each score knife housing to contact an adjacent score knife housing. In this configuration, the minimum space between two adjacent score knives is approximately equal to a width of a score knife housing. A score knife positioner is configured to nest with adjacent score knife positioners by using a specially constructed carriage bracket having a width less than a width of a score knife housing and being configured to receive a pair of linear bearings spaced apart from one another and locate the linear bearings to prevent contacting linear bearings of adjacent score knife positioners.

Positioning of linear bearings on each score knife positioner along with the width of carriage brackets associated with each score knife being thinner than a width of score knife assemblies on each carriage bracket allow spacing between cuts caused by the score knives to be less than one-half inch. This allows locating multiple score knife positioners to make multiple one-half inch cuts in material.

Figure 7:
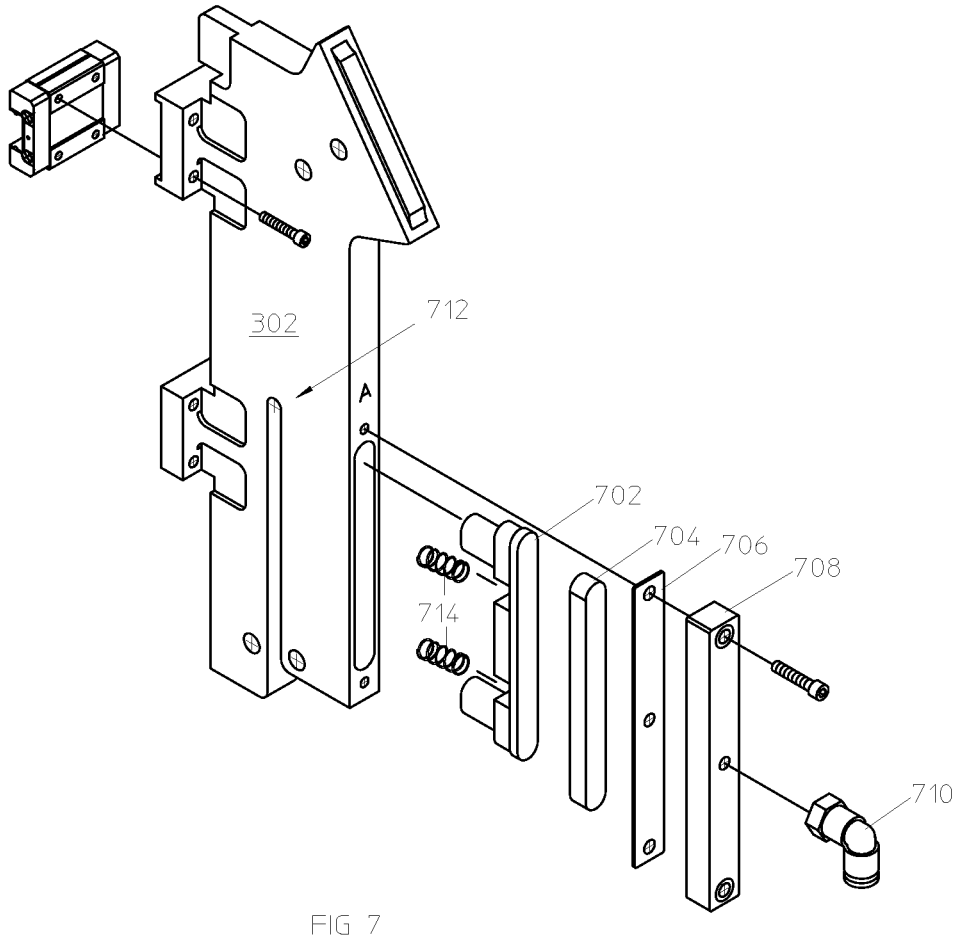
FIG. 7 depicts an exploded view of a portion of the score knife carriage assembly of FIG. 3A.

FIG. 7 depicts an exploded view of carriage brake assembly 316 of score knife carriage assembly 300 (shown in FIGS. 3A and 3B). Carriage brake assembly 316 includes brake piston 702 configured to be moved through one surface of carriage bracket 302 toward an opposing surface of carriage bracket 302 via pneumatic pressure input to brake piston seal 704 via fitting 710 connected to carriage brake piston cap 708. Gasket 706 substantially seals a recess in carriage bracket 302 in which brake piston 702 is located. Open-ended slot 712 between a face of brake piston 702 and the opposing surface of carriage bracket 302.

In operation, air fed into fitting 710 through carriage brake piston cap 708 urges brake piston seal 704 and brake piston 702 toward the opposing surface of carriage bracket 302 as described above. Brake springs 714 resist movement of brake piston 702 toward the opposing surface of carriage bracket 302.

In one embodiment, carriage brake assembly 316 is actuated pneumatically, but can be actuated hydraulically or via other methods in other embodiments. Carriage brake assembly 316 is configured to be actuated independent of carriage brakes on other carriage assemblies allowing a particular carriage assembly to be locked into position individually. As such, each score knife carriage assembly can be moved to a location and locked into position using a respective carriage brake assembly. Locking each score knife carriage assembly individually prevents drift and inaccuracy as compared to other systems in which all carriage assemblies are moved to a location and then locked simultaneously. This is because systems which lock all carriage assemblies simultaneously also require that all carriage assemblies be positioned before they are all locked which allows individual carriage assemblies previously positioned to move before the common carriage brake is applied. In one embodiment, each carriage brake assembly has a solenoid valve to control its actuation. Therefore, each carriage assembly can be locked into position while the positioning device is still engaged with the carriage assembly thereby eliminating the possibility of drifting out of position before the brake is applied. A system controller and its' operating software determine when each solenoid will be activated. In another embodiment, manually-operated valves can be used to individually control the brakes. In another embodiment, a simplified arrangement utilizes a common solenoid to actuate the brakes simultaneously.

Figure 8:
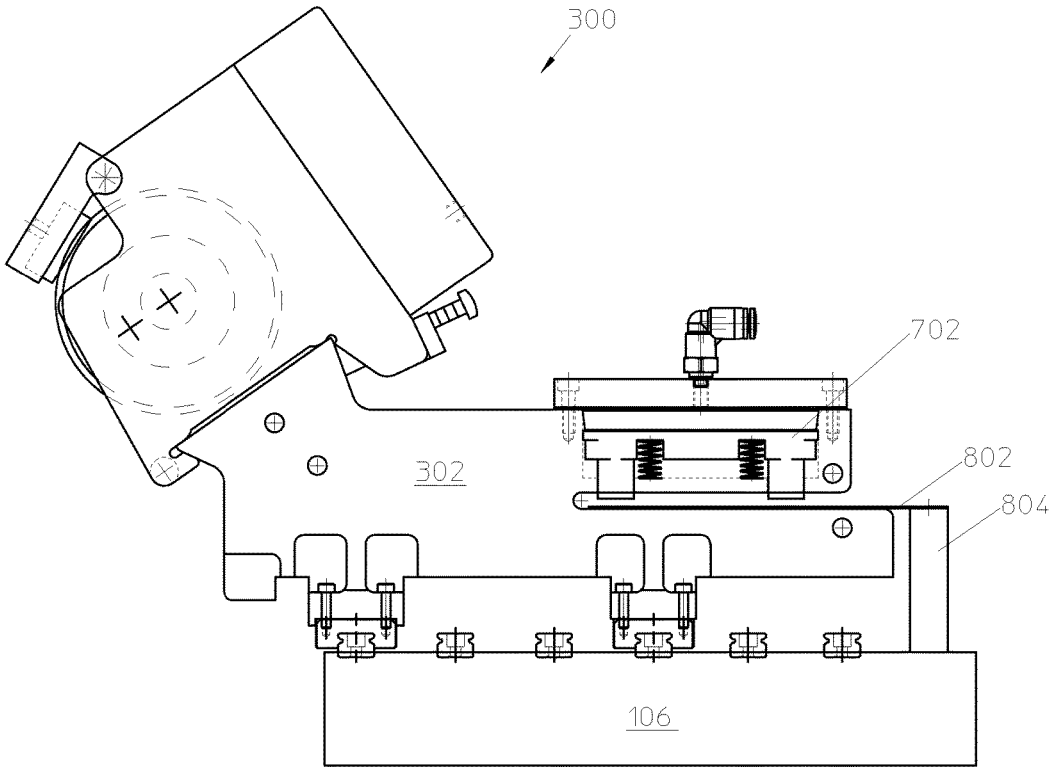
FIG. 8 depicts a brake assembly of the score knife carriage assembly of FIG. 3A with a brake engaged.

FIG. 8 depicts score knife carriage assembly 300 located to engage with flexible brake plate 802 which is mounted to positioning back plate 106 via standoff 804. As shown in FIG. 8, brake piston 702 is not currently actuated and score knife carriage assembly is free to move along positioning back plate 106.

Figure 9:
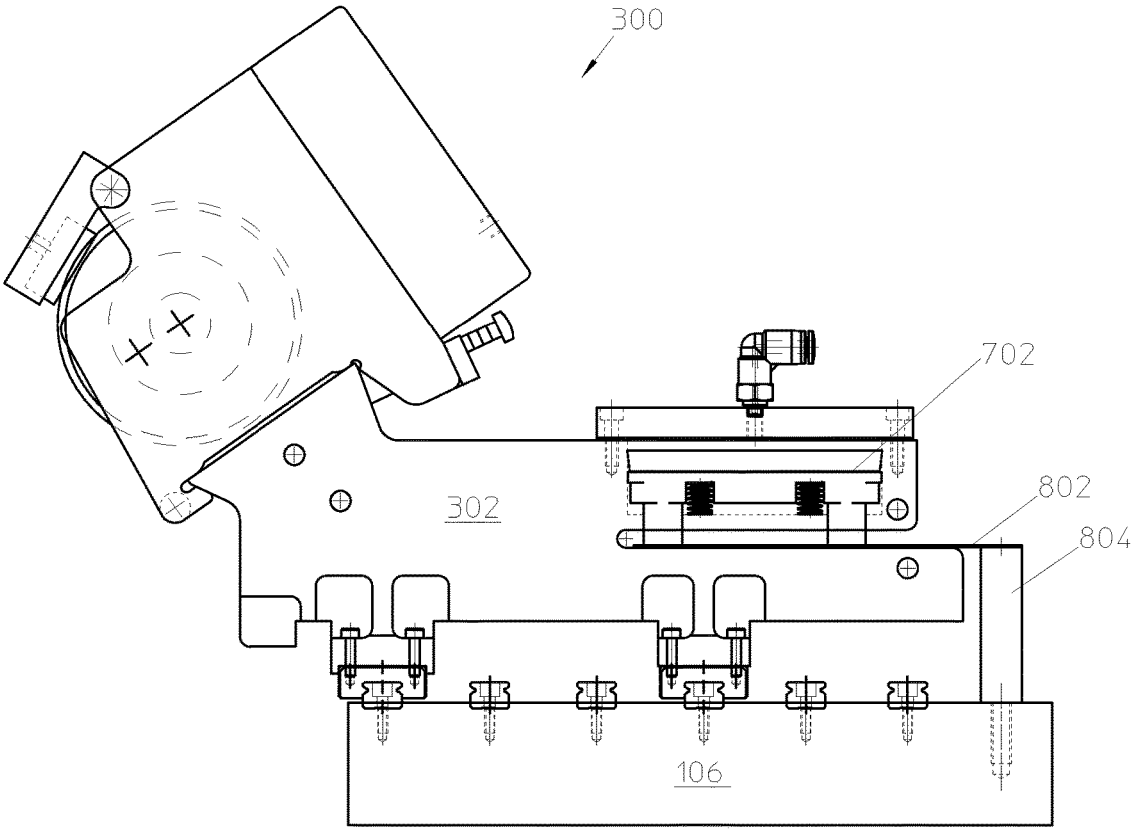
FIG. 9 depicts a brake assembly of the score knife carriage assembly of FIG. 3A with the brake disengaged.

FIG. 9 depicts score knife carriage assembly 300 locked into a desired position. Pneumatic operation of brake assembly 316 causes brake piston 702 to extend and capture flexible brake plate 802 between brake piston 702 an a surface of carriage bracket 302.

Brake piston 702 is depicted in FIGS. 7, 8, and 9 as comprising a pair of feet extending substantially perpendicular from a common member. This configuration provides two points of contact with flexible brake plate 802. The two points of contact lock score knife carriage assembly 300 in a location along positioning back plate 106 and prevent and/or minimize wobbling of score knife carriage assembly 300. In one embodiment, brake piston 702 comprises a single foot. In other embodiments, brake piston 702 comprises more than two feet and may be shaped differently (e.g., square feet, triangular feet, etc.).

Figure 10:
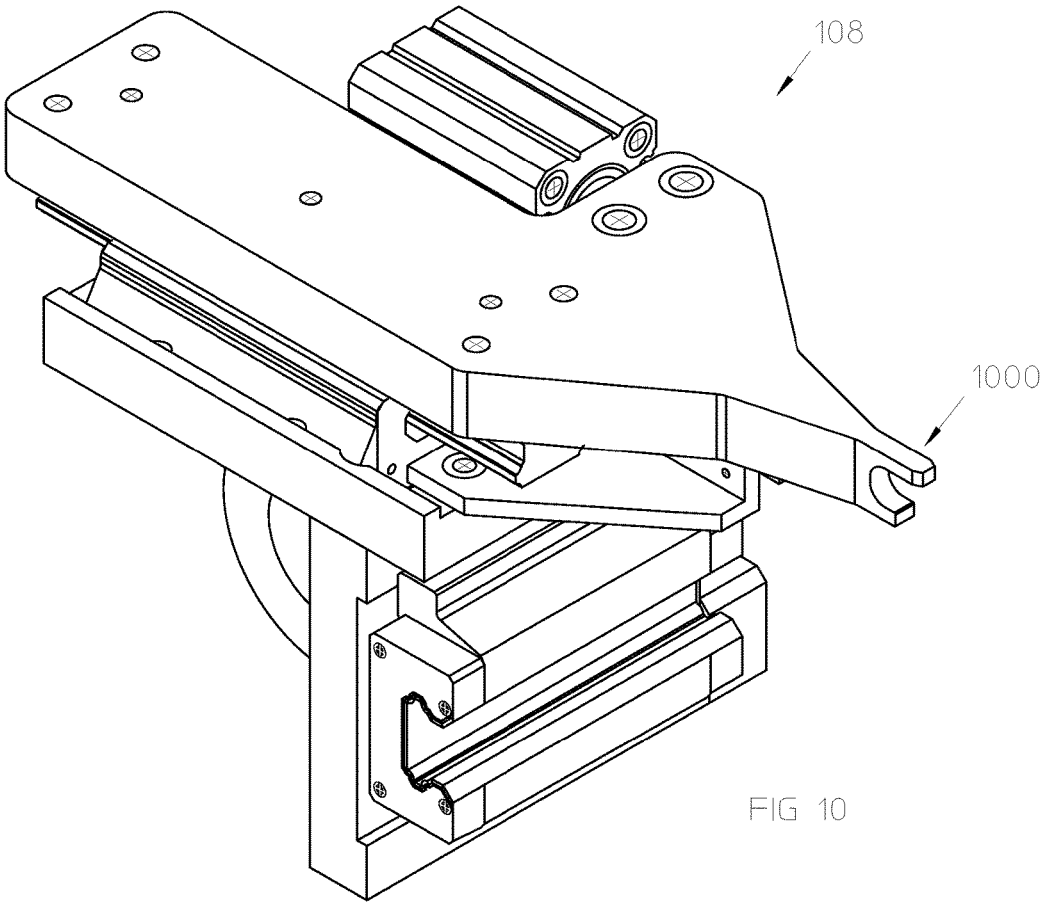
FIG. 10 depicts a pick and place mechanism according to one embodiment.

FIG. 10 depicts pick and place mechanism 108 comprising fork 1000 configured to engage score knife holders of score knife carriage assemblies. Fork 1000, as described in detail as follows, can be extended to engage a score knife holder of a score knife carriage assembly. Pick and place mechanism 108 then moves an engaged score knife carriage assembly to a desired location and the carriage brake assembly of the score knife carriage assembly can be actuated to lock the score knife carriage assembly in a desired position.

Figure 11:
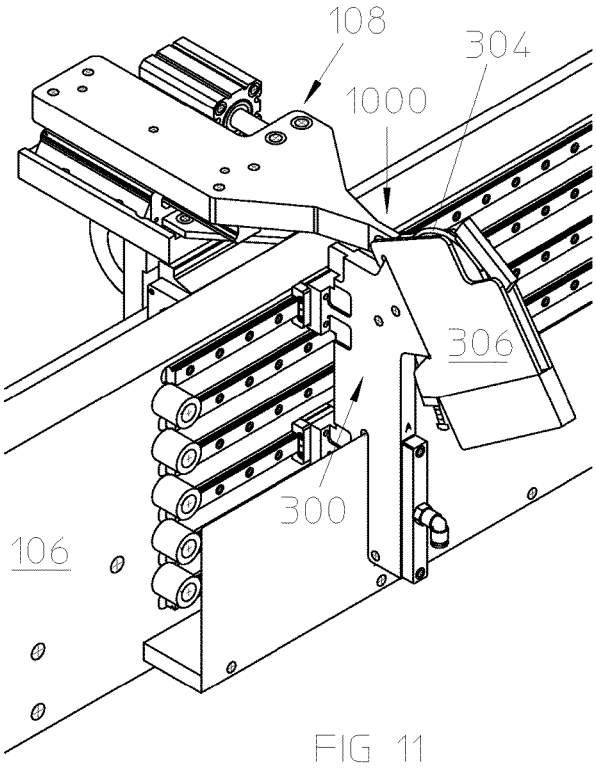
FIG. 11 depicts the pick and place mechanism of FIG. 10 engaging a first score knife carriage assembly according to one embodiment.

FIG. 11 depicts fork 1000 of pick and place mechanism 108 engaging score knife carriage assembly 300. In one embodiment, fork 1000 engages a portion of score knife holder 306 near score knife 304. Engaging and moving score knife carriage assembly 300 near score knife 304 provides numerous benefits. One benefit is that fork 1000 engaging score knife holder 306 near score knife 304 allows score knife carriage 300 to be positioned precisely and accurately. Since fork 1000 engages score knife holder 306 near score knife 304, there is little or no variation in the position of score knife 304 with respect to a particular position of fork 1000. In other systems where a score knife carriage assembly is moved by engaging a portion of the assembly far from the associated score knife, the accuracy and precision of the score knife is compromised. This can be due to wobble and other unintentional movement of the score knife with respect to the pick and place mechanism.

Figure 12:
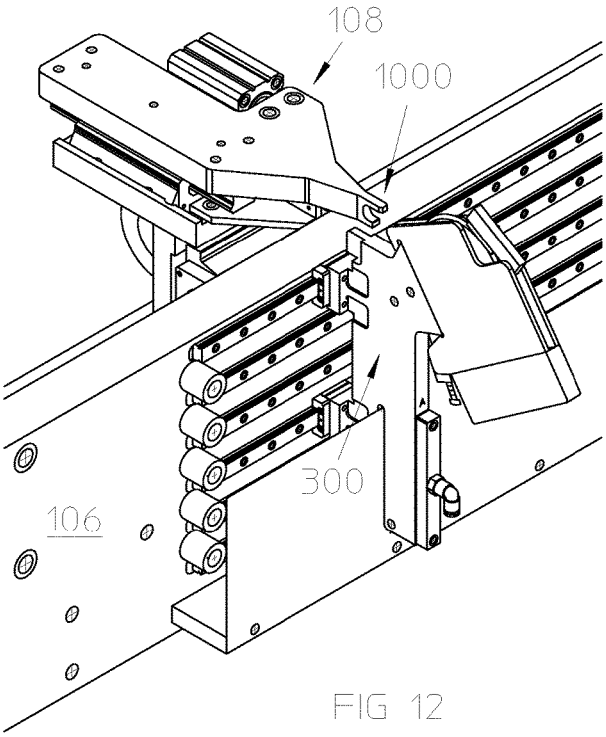
FIG. 12 depicts the pick and place mechanism of FIG. 10 disengaged from the first score knife carriage assembly according to one embodiment.

FIG. 12 depicts score knife carriage assembly 300 located in a desired position. Fork 1000 is shown disengaged from score knife carriage assembly 300 which occurs, in one embodiment, after score knife carriage assembly 300 has been locked in place via the associated carriage brake assembly.

Figure 13:
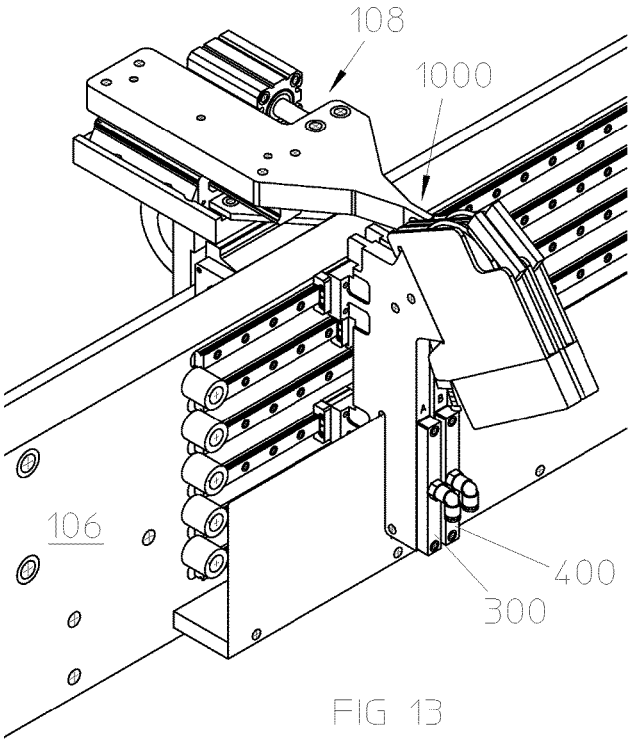
FIG. 13 depicts the pick and place mechanism of FIG. 10 engaging a second score knife carriage assembly according to one embodiment.

FIG. 13 depicts fork 1000 of pick and place assembly 108 moving score knife carriage assembly 400 into a desired location. After score knife carriage assembly 400 is moved to the desired location, the carriage brake assembly associated with score knife carriage assembly 400 is engaged and fork 1000 is disengaged from score knife carriage assembly 400.

Figure 14:
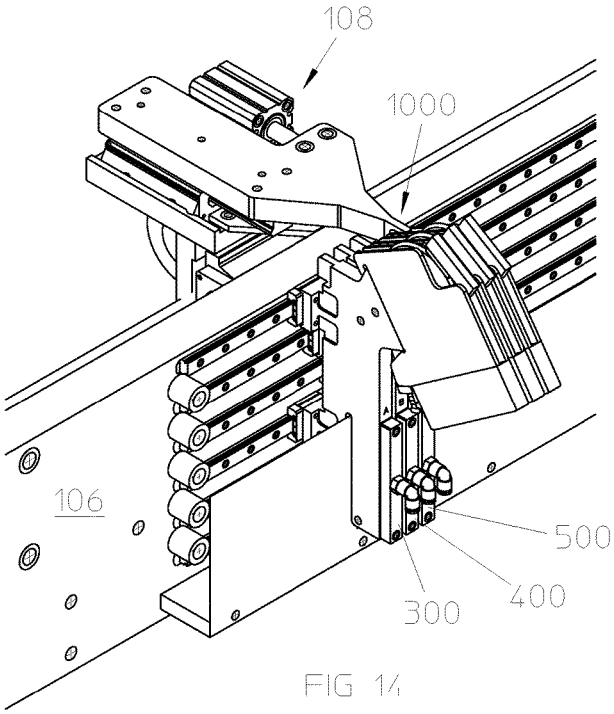
FIG. 14 depicts the pick and place mechanism of FIG. 10 engaging a third score knife carriage assembly according to one embodiment.

FIG. 14 depicts fork 1000 of pick and place assembly 108 moving score knife carriage assembly 500 into a desired location. After score knife carriage assembly 500 is moved to the desired location, the carriage brake assembly associated with score knife carriage assembly 500 is engaged and fork 1000 is disengaged from score knife carriage assembly 500.

Movement of score knife carriage assemblies via pick and place mechanism 108 is repeated as necessary until all score knife carriage assemblies are located in their desired positions to convert a web of material into multiple strips of material having desired widths.

Returning to FIG. 1, it should be noted that in some instances, not all score knife carriage assemblies available are required for web conversion. In these cases, score knife carriage assemblies that are not needed for a particular operation are moved to storage area 112 of score knife positioning assembly 100 until needed.

Figure 15:
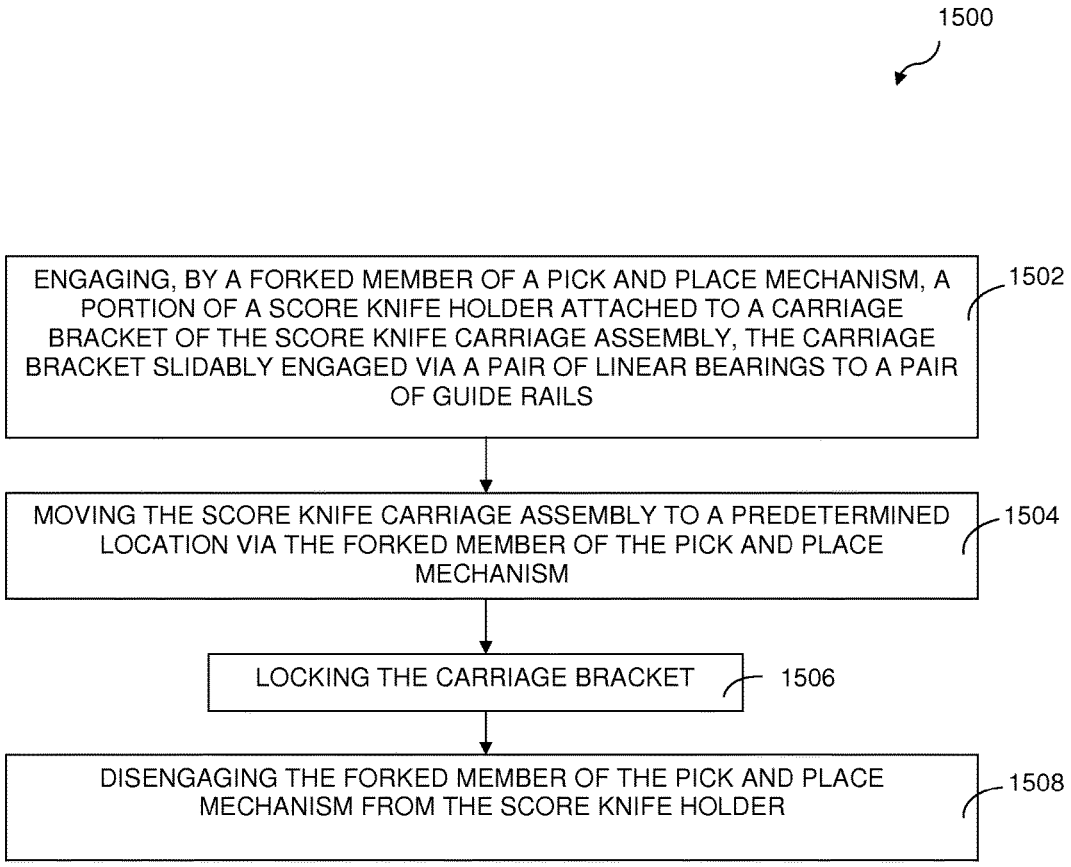
FIG. 15 depict a flow chart of a method of operation of a pick and place mechanism using a controller according to one embodiment.

FIG. 15 depicts flow chart 1500 of a method for positioning a score knife carriage assembly using a controller according to one embodiment. At step 1502 a portion of a score knife holder attached to a carriage bracket of a score knife carriage assembly is engaged by a forked member of a pick and place mechanism. The carriage bracket is slidably engaged via a pair of linear bearings to a pair of guide rails. At step 1504, the score knife carriage assembly is moved to a predetermined location via the forked member of the pick and place mechanism. At step 1506, the carriage bracket is locked in position via the carriage brake assembly. At step 1508, the forked member of the pick and place mechanism is disengaged from the score knife holder. In one embodiment, the method steps are repeated for each score knife carriage assembly until all score knife carriage assemblies are located and locked in their desired positions.

Figure 16:
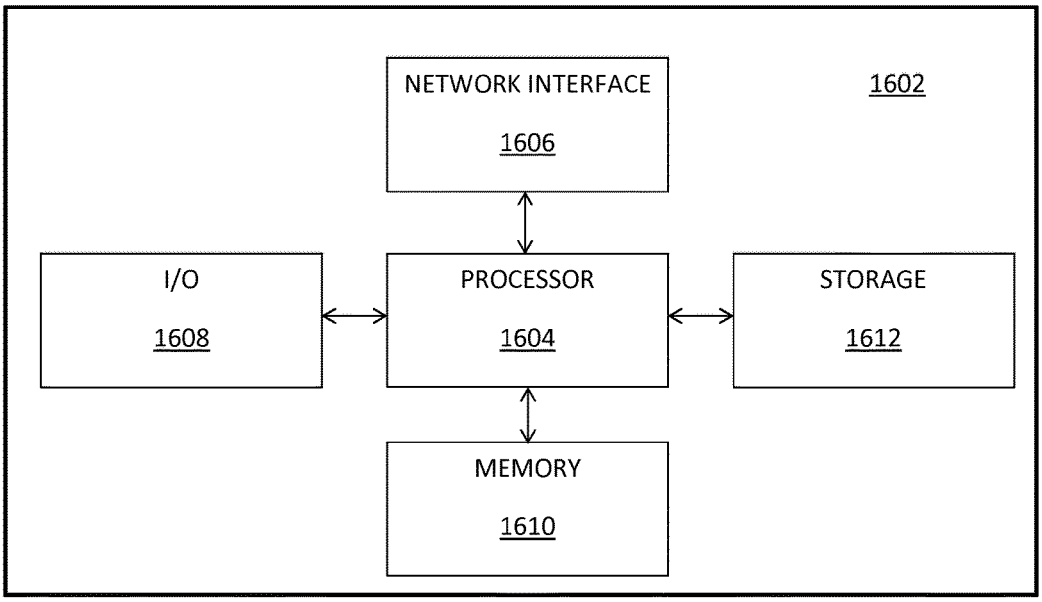
FIG. 16 depicts a high-level block diagram of a computer that can be used to implement the method for positioning a score knife carriage assembly using a controller.

In one embodiment, operation of score knife positioning assembly 100 is controlled by a controller. In one embodiment, the controller used to implement the method for positioning a score knife carriage assembly can be a computer. A high-level block diagram of such a computer is illustrated in FIG. 16. Computer 1602 contains a processor 1604 which controls the overall operation of the computer 1602 by executing computer program instructions which define such operation. The computer program instructions may be stored in a storage device 1612, or other computer readable medium (e.g., magnetic disk, CD ROM, etc.), and loaded into memory 1610 when execution of the computer program instructions is desired. Thus, the method steps of FIG. 15 can be defined by the computer program instructions stored in the memory 1610 and/or storage 1612 and controlled by the processor 1604 executing the computer program instructions. For example, the computer program instructions can be implemented as computer executable code programmed by one skilled in the art to perform an algorithm defined by the method steps of FIG. 15. Accordingly, by executing the computer program instructions, the processor 1604 executes an algorithm defined by the method steps of FIG. 15. The computer 1602 also includes one or more network interfaces 1606 for communicating with other devices via a network. The computer 1602 also includes input/output devices 1608 that enable user interaction with the computer 1602 (e.g., display, keyboard, mouse, speakers, buttons, etc.) One skilled in the art will recognize that an implementation of an actual computer could contain other components as well, and that FIG. 16 is a high level representation of some of the components of such a computer for illustrative purposes.

The foregoing Detailed Description is to be understood as being in every respect illustrative and exemplary, but not restrictive, and the scope of the inventive concept disclosed herein is not to be determined from the Detailed Description, but rather from the claims as interpreted according to the full breadth permitted by the patent laws. It is to be understood that the embodiments shown and described herein are only illustrative of the principles of the inventive concept and that various modifications may be implemented by those skilled in the art without departing from the scope and spirit of the inventive concept. Those skilled in the art could implement various other feature combinations without departing from the scope and spirit of the inventive concept.

The invention claimed is:

1. A method for positioning a score knife carriage assembly comprising:

directly engaging, by a forked member of a pick and place mechanism, a score knife holder removably attached to a score knife carriage of a first score knife carriage assembly, the score knife holder for holding a score knife, the first score knife carriage assembly slidably engaged via a linear bearing to a first guide rail, the forked member having at least two prongs for engaging the score knife holder and inserted between opposing walls of the score knife holder on a side of the score knife holder adjacent to the score knife carriage;

slidably moving the first score knife carriage assembly, substantially perpendicular to a plane of the score knife carriage, along the first guide rail to a first predetermined location using the forked member of the pick and place mechanism;

locking the first score knife carriage assembly at the first predetermined location to a brake plate; and disengaging the forked member of the pick and place mechanism from the score knife holder of the first score knife carriage assembly.

2. The method of claim 1, further comprising:

directly engaging, by the forked member of the pick and place mechanism, a score knife holder removably attached to a score knife carriage of a second score knife carriage assembly, the second score knife carriage assembly slidably engaged via a second linear bearing to a second guide rail, the forked member inserted between opposing walls of the score knife holder; and slidably moving the second score knife carriage assembly along the second guide rail to a second predetermined location using the forked member of the pick and place mechanism so that a score knife of the second score knife carriage assembly is located approximately one-half inch from a score knife of the first score knife carriage assembly.

3. The method of claim 2, further comprising:

locking the second score knife carriage assembly at the second predetermined location to the brake plate; and disengaging the forked member of the pick and place mechanism from the score knife holder of the second score knife carriage assembly.

4. The method of claim 3, further comprising:

engaging, by the forked member of the pick and place mechanism, the score knife holder of the second score knife carriage assembly;

unlocking the second score knife carriage assembly; and slidably moving the second score knife carriage assembly to a third predetermined location using the forked member of the pick and place mechanism.

5. The method of claim 3, further comprising:

directly engaging, by the forked member of the pick and place mechanism, the score knife holder of the second score knife carriage assembly, the forked member inserted between opposing walls of the score knife holder;

unlocking the second score knife carriage assembly; and slidably moving the second score knife carriage assembly to a storage area located at an end of the second guide rail.

6. The method of claim 1, wherein the locking the first score knife carriage assembly is by a pneumatically actuated brake associated with the first score knife carriage assembly.

7. The method of claim 1, wherein the engaging occurs when the first score knife carriage assembly is located in a storage area located at an end of the first guide rail.

8. The method of claim 1, wherein the score knife holder of the first score knife carriage assembly is removably attached to the score knife carriage of the first score knife carriage assembly, the score knife holder located with respect to the score knife carriage assembly by a tab.

9. The method of claim 1 wherein the locking the first score knife carriage assembly at the first predetermined location to the brake plate is via a brake of the first score knife carriage assembly, the brake comprising a foot extendible to frictionally retain of portion of the brake plate between the foot and a surface of the first score knife carriage assembly opposite the foot.

10. A method for positioning a score knife carriage assembly comprising:

directly engaging, by a forked member of a pick and place mechanism, a score knife holder removably attached to a score knife carriage of a first score knife carriage assembly, the score knife holder for holding a score knife, the forked member having at least two prongs for engaging the score knife holder and inserted between opposing walls of the score knife holder on a side of the score knife holder adjacent to the score knife carriage;

slidably moving the first score knife carriage assembly, substantially perpendicular to a plane of the score knife carriage, along a first guide rail to a first predetermined location using the forked member of the pick and place mechanism; and locking the first score knife carriage assembly at the first predetermined location to a brake plate.

11. The method of claim 10 further comprising:

disengaging the forked member of the pick and place mechanism from the score knife holder of the first score knife carriage assembly.

12. The method of claim 11, further comprising:

directly engaging, by the forked member of the pick and place mechanism, a score knife holder removably attached to a score knife carriage of a second score knife carriage assembly, the forked member inserted between opposing walls of the score knife holder; and slidably moving the second score knife carriage assembly along a second guide rail to a second predetermined location using the forked member of the pick and place mechanism so that a score knife of the second score knife carriage assembly is located less than one-half inch from a score knife of the first score knife carriage assembly.

13. The method of claim 12, further comprising:

locking the second score knife carriage assembly at the second predetermined location to the brake plate; and disengaging the forked member of the pick and place mechanism from the score knife holder of the second score knife carriage assembly.

14. The method of claim 13, further comprising:

engaging, by the forked member of the pick and place mechanism, the score knife holder of the second score knife carriage assembly;

unlocking the second score knife carriage assembly; and slidably moving the second score knife carriage assembly to a third predetermined location using the forked member of the pick and place mechanism.

15. The method of claim 13, further comprising:

directly engaging, by the forked member of the pick and place mechanism, the score knife holder of the second score knife carriage assembly, the forked member inserted between opposing walls of the score knife holder;

unlocking the second score knife carriage assembly; and slidably moving the second score knife carriage assembly to a storage area located at an end of the second guide rail.

16. The method of claim 11, wherein the locking the first score knife carriage assembly is by a pneumatically actuated brake assembly associated with the first score knife carriage assembly.

17. The method of claim 11, wherein the locking the first score knife carriage assembly at the first predetermined location to the brake plate is via a brake of the first score knife carriage assembly, the brake comprising a foot extendible to frictionally retain of portion of the brake plate between the foot and a surface of the first score knife carriage assembly opposite the foot.

18. The method of claim 10, wherein the engaging occurs when the first score knife carriage assembly is located in a storage area located at an end of the first guide rail.

19. The method of claim 10, wherein the score knife holder of the first score knife carriage assembly is removably attached to the score knife carriage of the first score knife carriage assembly, the score knife holder located with respect to the score knife carriage assembly by a tab.

* * * * *